US010991481B2

(12) United States Patent
Eberling et al.

(10) Patent No.: US 10,991,481 B2
(45) Date of Patent: Apr. 27, 2021

(54) POLYMER-COATED WIRES

(71) Applicant: Zeus Industrial Products, Inc., Orangeburg, SC (US)

(72) Inventors: Zeth Eberling, Columbia, SC (US); Richard Crowley, Bamberg, SC (US); Brian R. Tomblin, Columbia, SC (US)

(73) Assignee: Zeus Industrial Products, Inc., Orangeburg, SC (US)

( * ) Notice: Subject to any disclaimer, the term of this patent is extended or adjusted under 35 U.S.C. 154(b) by 0 days.

(21) Appl. No.: 17/091,542

(22) Filed: Nov. 6, 2020

(65) Prior Publication Data

US 2021/0057125 A1 Feb. 25, 2021

Related U.S. Application Data

(63) Continuation of application No. 17/031,002, filed on Sep. 24, 2020, which is a continuation of application No. 16/548,906, filed on Aug. 23, 2019, now abandoned.

(51) Int. Cl.

| | |
|---|---|
| ***H01B 7/02*** | (2006.01) |
| ***H01B 3/10*** | (2006.01) |
| ***H01B 13/14*** | (2006.01) |
| ***H01B 3/42*** | (2006.01) |

(52) U.S. Cl.

CPC ..... *H01B 7/0283* (2013.01); *H01B 3/105* (2013.01); *H01B 3/427* (2013.01); *H01B 7/0216* (2013.01); *H01B 13/145* (2013.01)

(58) Field of Classification Search

CPC ..... H01B 7/0283; H01B 3/105; H01B 3/427; H01B 7/0216; H01B 3/145

See application file for complete search history.

(56) References Cited

U.S. PATENT DOCUMENTS 2,947,069 A * 8/1960 Carlson ..... B21C 1/16 428/629
3,906,139 A 9/1975 Hiraoka
4,439,255 A * 3/1984 Imai ..... H01B 7/0208 156/155

(Continued)

OTHER PUBLICATIONS

PCT Search Report & Written Opinion dated Dec. 2, 2020 which issued in corresponding PCT Application No. PCT/US2020/047379.

*Primary Examiner* — Timothy J Thompson
*Assistant Examiner* — Rhadames Alonzo Miller
(74) *Attorney, Agent, or Firm* — Jessica Gorczynski; Womble Bond Dickinson (US) LLP

(57) ABSTRACT

The present disclosure provides insulated electrical conductors, e.g., wires, and methods for producing such insulated electrical conductors to combat partial discharge by enhancing bond strength between the electrical conductor and a base insulating thermoplastic layer (e.g., including a PAEK). Such insulated electrical conductors can include: an electrical conductor; an insulating coating on at least a portion of a surface of the electrical conductor; and an oxide layer between the electrical conductor and the insulating coating. Methods for producing such insulated electrical conductors can involve extrusion of an insulating polymer onto the electrical conductor under ambient atmosphere and a subsequent heat treatment step, which can also be conducted under ambient atmosphere.

26 Claims, 4 Drawing Sheets

(56) References Cited

U.S. PATENT DOCUMENTS 5,091,609 A * 2/1992 Sawada ..... C23C 18/1216 174/110 A
5,336,851 A * 8/1994 Sawada ..... H01B 3/105 174/110
5,368,935 A * 11/1994 Inazawa ..... C08G 77/60 174/110 S
5,372,886 A * 12/1994 Inazawa ..... H01B 3/105 174/110 A
5,431,954 A * 7/1995 Inazawa ..... C08G 77/60 427/117
5,436,409 A 7/1995 Sawada et al.
5,532,434 A * 7/1996 Takeno ..... B23K 26/18 174/110 A
2002/0053461 A1* 5/2002 Leijon ..... H01F 27/288 174/128.1
2003/0098176 A1 5/2003 Mesaki
2004/0126504 A1* 7/2004 Ouchi ..... C08G 77/54 428/1.1
2004/0149734 A1* 8/2004 Petrenko ..... B60S 1/026 219/538
2007/0003781 A1* 1/2007 de Rochemont ..... H05K 1/162 428/615
2008/0047736 A1* 2/2008 Levine ..... H01B 7/0036 174/126.2
2008/0179074 A1* 7/2008 Elie ..... H01B 3/105 174/110 R
2008/0258337 A1* 10/2008 Ajbani ..... C08L 81/02 264/241
2009/0271977 A1* 11/2009 Elie ..... H01B 3/105 29/825
2010/0130669 A1* 5/2010 Higuchi ..... C08L 15/00 524/526
2011/0226508 A1 9/2011 Aoi
2012/0279752 A1 11/2012 Oya
2013/0025907 A1 1/2013 Zheng et al.
2013/0130031 A1* 5/2013 Yamazaki ..... H01B 3/442 428/375
2014/0069686 A1 3/2014 Abe
2014/0224522 A1* 8/2014 Yamazaki ..... H01B 3/308 174/110 SR
2014/0353000 A1* 12/2014 Yin ..... H01B 3/04 174/113 R
2014/0354394 A1 12/2014 Oya
2015/0021067 A1* 1/2015 Muto ..... H01B 13/065 174/110 SR
2016/0322126 A1 11/2016 Oya
2017/0084361 A1 3/2017 Oya et al.
2017/0148547 A1 5/2017 Dolan et al.
2017/0178765 A1* 6/2017 Ikeda ..... H01B 3/42
2018/0005724 A1* 1/2018 Bonnet ..... H02K 3/30
2019/0131037 A1* 5/2019 Hochstoger ..... H01B 13/145
2019/0371496 A1 12/2019 Oya

* cited by examiner

POLYMER-COATED WIRES

CROSS-REFERENCE TO RELATED APPLICATION

The present application is a continuation of U.S. patent application Ser. No. 17/031,002, filed Sep. 24, 2020; which application is a continuation of U.S. patent application Ser. No. 16/548,906, filed Aug. 23, 2019, and the contents of the foregoing applications are incorporated by reference herein in their entirety.

FIELD OF THE INVENTION

The present application relates generally to the field of insulated electrical conductors and to methods relating to such insulated electrical conductors.

BACKGROUND OF THE INVENTION

Electrical conductors are materials that allow the flow of charge (current) therethrough. Wires are one of the most common forms of electrical conductors, and are commonly made of metals, such as aluminum, copper, or alloys thereof. Within such electrical conductors, electrons flow, which can generate heat due to activity of electrons moving among atoms and the high speed motion associated therewith.

Devices containing electrical conductors, such as wires, could not operate properly without the aid of electrical insulators. In particular, wires are typically coated with an insulator to prevent excess generation of heat/fire concerns, to prevent electrical shock, and to ensure proper functioning and safety of the conductor and the device or devices with which the conductor is associated. Adhesion between the insulation and the underlying electrical conductor is important, e.g., to avoid air gaps that can result in partial electrical discharge during use. Electrical discharges can occur, e.g., between the conductor and adjacent insulation, particularly when an air gap/delamination is present between the conductor and the insulating layer (as referenced above), within the insulating layer, and/or from the exterior of the insulating layer (where the material discharges to another nearby wire or motor feature, i.e., Corona discharge). When wires are aggressively formed (such as in winding a motor), good adhesion (including little to no air gap between the insulation and the electrical conductor) is particularly important to mitigate at least the first mode of discharge.

Polymers are a common material employed for wire insulation for a number of reasons. Certain polymers can be highly resistant to electrical current, can be flexible (and therefore can be readily bent around corners and directed into electrical boxes safely), can dissipate heat readily, can be slow burning, and can be relatively inexpensive. In particular, polyetherketones, such as polyether ether ketone (PEEK) are highly desired as insulation for conductive wires because of their typically high temperature operating window and their inherent resistance to many chemicals present in industrial and automotive environments. However, direct extrusion of thermoplastic polymers such as PEEK over metals such as those used within electrical conductors is commonly problematic in that such thermoplastics typically do not bond well to such metals (which, as referenced above, leads to numerous concerns associated with air gaps and delamination). Adhesion of these polymers to the conductor is believed to suffer from the presence/formation of an oxide layer during processing and it is generally understood in the art that the presence of an oxide layer is detrimental to adhesion. As such, attempts have been made to exclude oxygen from the metal surface during coating/bonding processes to provide an insulating layer on the electrical conductor. See, e.g., EP3441986, which is incorporated herein by reference in its entirety. Alternative methods have also been employed to address the adhesion concern, involving the application of multiple polymeric layers (e.g., including a baked enamel layer). See, e.g., US Pat. Publ. No. 2015/0021067, which is incorporated herein by reference in its entirety. In such multilayered arrangements, delamination between adjacent layers may disadvantageously again result in the formation of air gaps within insulated wires.

Some attempts have been made to improve adhesion of an insulator to a wire by using "pressure coating" techniques to improve intimate contact between the insulator and the underlying wire. Pressure coating is distinguished from general extrusion, as in pressure coating the wire pin/mandrel is retracted back inside the outer forming die in the thermoplastic extrusion tooling. This allows the wire to be coated with high pressure resin prior to exiting the machine. In pressure coating, a die is used that is similar in size to the OD of the product and the wire leaves the extruder in coated form. By contrast, in traditional "jacket or sleeve coating," a larger toolset is used and a tube is extruded in the same direction as the wire travels through the machine; this tube is drawn down after exiting the extruder and brought into contact with the conductor. The forming die and pin/mandrel in a jacket or sleeve coating steup are flush or close to flush at the exit of the machine and there is an air gap between the tube exiting and the conductor. The process is run such that the tube is drawn down into intimate contact with the conductor.

It is generally understood that pressure coating techniques can improve the "grip" of an insulating layer to a wire, but these techniques do not create any bond to the underlying oxide layer on the surface of the wire. Further, pressure coating may be undesirable over other alternative process such as jacket coating where a larger tubing toolset can be used, allowing lower pressure, easier control of insulation concentricity/uniformity, and much higher coating line speeds.

It would be advantageous to provide further processes for the preparation of coated electrical conductors that can afford effective adhesion between the polymer coating and the underlying conductor.

SUMMARY OF THE INVENTION

The disclosure provides methods for providing coated (insulated) electrical conductors and, in particular, methods resulting in effective adhesion between the insulating coating and the electrical conductor. The disclosure further describes the resulting coated electrical conductors and the properties and characteristics thereof.

The inventors have developed, contrary to conventional understanding, a method for the production of coated electrical conductors that is conducted in ambient air, without rigorous attention to the exclusion of oxygen from the atmosphere. The method disclosed herein can provide coated/insulated electrical conductors exhibiting sufficient adhesion between the insulating coating and the underlying electrical conductor. The coated electrical conductors produced via this method advantageously are highly resistant to delamination of the insulating coating from the electrical conductor, as will be described and demonstrated more fully herein below.

The disclosure provides, in one aspect, an insulated electrical conductor, comprising: an electrical conductor comprising an oxide layer on at least part of a surface of the electrical conductor; and an insulating coating on at least a portion of the oxide layer, wherein the insulated electrical conductor exhibits adhesion between the insulating coating and one or more of the electrical conductor and the oxide layer such that the insulating coating is not strippable from the electrical conductor. The referenced feature of the insulating coating being "not strippable" can mean that the insulating coating cannot be pulled off of the electrical conductor in full or partial tubular form (e.g., at ambient conditions/in air at room temperature).

The features of the electrical conductor can vary. In some embodiments, the electrical conductor is a wire. In some embodiments, the electrical conductor has a cross-sectional shape that is round, square, triangular, rectangular, polygonal, or elliptical. In some embodiments, the electrical conductor comprises copper, aluminum, or a combination thereof. In particular embodiments, the electrical conductor comprises copper. In some embodiments, the electrical conductor comprises a silver, nickel, or gold coating.

Similarly, the features of the insulating coating can vary. In some embodiments, the insulating coating comprises a polyaryl ether ketone (PAEK). Exemplary PAEK polymers include, but are not limited to, polyether ketone (PEK), polyether ether ketone (PEEK), polyetherketoneketone (PEKK), polyether ether ketone ketone (PEEKK), and polyether ketone ether ketone ketone (PEKEKK). The insulating coating may, in certain embodiments, further comprise one or more fibers, fillers, or a combination thereof. In some embodiments, the insulating coating comprises a polymeric alloy of a PAEK with one or more fluororesins. In other embodiments, the insulating coating consists essentially of a polymer, e.g., a PAEK.

In some embodiments, an insulated electrical conductor is provided, wherein the electrical conductor is a wire with a circular cross-section that has a tan δ damping ratio of 1.10 or less when measured according to the following procedure: a) heating a coated wire held by a cantilever grip in a DMA instrument a first time from room temperature up to a temperature, T1, corresponding to a peak of a melting endotherm (determined by DSC); b) cooling the coated wire back to room temperature after one minute at T1; c) heating the coated wire a second time up to T1; d) determining the slope, m1, of the tan δ curve at the start of a thermal transition region of the polymer during the first heating cycle; e) determining the slope, m2, of the tan δ curve at the start of a thermal transition region of the polymer during the second heating cycle; and f) calculating the tan δ damping ratio by dividing m1 by m2.

In some embodiments, an insulated electrical conductor is provided, wherein the electrical conductor is a wire with a rectangular cross-section that has a tan S damping ratio of less than 1.60 when measured according to the following procedure: a) heating a coated wire held by a cantilever grip in a DMA instrument a first time from room temperature up to a temperature, T1, corresponding to a peak of a melting endotherm (determined by DSC); b) Cooling the coated wire back to room temperature after one minute at T1; b) heating the coated wire a second time up to T1; c) determining the slope, m1, of the tan δ curve at the start of a thermal transition region of the polymer during the first heating cycle; d) determining the slope, m2, of the tan δ curve at the start of a thermal transition region of the polymer during the second heating cycle; and e) calculating the tan δ damping ratio by dividing m1 by m2.

In some embodiments, the insulating coating being not strippable from the electrical conductor is determined by initiating a nick or tear in the insulating coating; peeling the insulating coating from the nick or tear lengthwise in air under ambient conditions along the coated electrical conductor to attempt to peel the insulating coating off the conductor; and observing that the insulating layer is not peeled from the electrical conductor in full or partial tubular form. In some embodiments, an electric motor comprising the insulated electrical conductor disclosed herein is provided.

In another aspect of the present disclosure is provided a method of preparing an insulated electrical conductor, comprising: providing an electrical conductor comprising metal oxides on at least a portion of the surface thereof; extruding a polymeric insulating coating onto at least a portion of the electrical conductor, wherein the extruding is conducted under ambient atmospheric conditions; cooling the coated electrical conductor; heat-treating the cooled, coated electrical conductor; and cooling the heat-treated coated electrical conductor to provide the insulated electrical conductor. In some embodiments, the extruding employs jacket coating tooling. In some embodiments, the extruding employs pressure coating tooling. As such, in some embodiments, the method provides a unique approach involving pressure coating technique to provide a coated conductor with a bond between the electrical conductor and the insulating coating, which is generally not obtainable via pressure coating.

The heat-treating, in certain embodiments, comprises subjecting the cooled, coated electrical conductor to a temperature at or above the glass transition temperature of the polymeric insulating coating. The heat-treating can further comprise holding the heated coated electrical conductor at the temperature for a specified period of time. In some embodiments, the extruding and heat-treating are conducted under ambient atmosphere. The disclosure further includes an insulated electrical conductor, prepared according to the methods provided in the present disclosure.

The present disclosure includes, without limitation, the following embodiments.

Embodiment 1

An insulated electrical conductor, comprising: an electrical conductor comprising an oxide layer on at least part of a surface of the electrical conductor; and an insulating coating on at least a portion of the oxide layer, wherein the insulated electrical conductor exhibits adhesion between the insulating coating and one or more of the electrical conductor and the oxide layer such that the insulating coating is not strippable from the electrical conductor.

Embodiment 2

The insulated electrical conductor of the preceding embodiment, wherein the electrical conductor is a wire.

Embodiment 3

The insulated electrical conductor of any preceding embodiment, wherein the electrical conductor has a cross-sectional shape that is round, square, triangular, rectangular, polygonal, or elliptical.

Embodiment 4

The insulated electrical conductor of any preceding embodiment, wherein the electrical conductor comprises copper, aluminum, or a combination thereof.

Embodiment 5

The insulated electrical conductor of any preceding embodiment, wherein the electrical conductor comprises copper or a copper alloy.

Embodiment 6

The insulated electrical conductor of any preceding embodiment, wherein the electrical conductor comprises a silver, nickel, or gold coating.

Embodiment 7

The insulated electrical conductor of any preceding embodiment, wherein the insulating coating comprises a polyaryl ether ketone (PAEK).

Embodiment 8

The insulated electrical conductor of any preceding embodiment, wherein the insulating coating further comprises one or more fibers, fillers, or a combination thereof.

Embodiment 9

The insulated electrical conductor of any preceding embodiment, wherein the insulating coating consists essentially of a polyaryl ether ketone (PAEK).

Embodiment 10

The insulated electrical conductor of any preceding embodiment, wherein the insulating coating comprises a polymer selected from the group consisting of polyether ketone (PEK), polyether ether ketone (PEEK), polyetherketoneketone (PEKK), polyether ether ketone ketone (PEEKK), and polyether ketone ether ketone ketone (PEKEKK).

Embodiment 11

The insulated electrical conductor of any preceding embodiment, wherein the insulating coating comprises a polymeric alloy of a PAEK with one or more fluororesins.

Embodiment 12

The insulated electrical conductor of any preceding embodiment, wherein the electrical conductor is a wire with a circular cross-section that has a tan δ damping ratio of 1.10 or less when measured according to the following procedure: a) heating a coated wire held by a cantilever grip in a DMA instrument a first time from room temperature up to a temperature, T1, corresponding to a peak of a melting endotherm (determined by DSC); b) cooling the coated wire back to room temperature after one minute at T1; c) heating the coated wire a second time up to T1; d) determining the slope, m1, of the tan δ curve at the start of a thermal transition region of the polymer during the first heating cycle; e) determining the slope, m2, of the tan δ curve at the start of a thermal transition region of the polymer during the second heating cycle; and f) calculating the tan δ damping ratio by dividing m1 by m2.

Embodiment 13

The insulated electrical conductor of any preceding embodiment, wherein the electrical conductor is a wire with a rectangular cross-section that has a tan δ damping ratio of less than 1.60 when measured according to the following procedure: a) heating a coated wire held by a cantilever grip in a DMA instrument a first time from room temperature up to a temperature, T1, corresponding to a peak of a melting endotherm (determined by DSC); b) cooling the coated wire back to room temperature after one minute at T1; b) heating the coated wire a second time up to T1; c) determining the slope, m1, of the tan δ curve at the start of a thermal transition region of the polymer during the first heating cycle; d) determining the slope, m2, of the tan δ curve at the start of a thermal transition region of the polymer during the second heating cycle; and e) calculating the tan δ damping ratio by dividing m1 by m2.

Embodiment 14

The insulated electrical conductor of any preceding embodiment, wherein the insulating coating being not strippable from the electrical conductor is determined by initiating a nick or tear in the insulating coating; peeling the insulating coating from the nick or tear lengthwise in air under ambient conditions along the coated electrical conductor to attempt to peel the insulating coating off the conductor; and observing that the insulating layer is not peeled from the electrical conductor in full or partial tubular form.

Embodiment 15

An electric motor comprising the insulated electrical conductor of any preceding embodiment.

Embodiment 16

A method of preparing an insulated electrical conductor, comprising: providing an electrical conductor comprising an oxide layer on at least part of a surface of the electrical conductor; extruding a polymeric insulating coating onto one or more of the electrical conductor and the oxide layer such that the insulating coating is not strippable from the electrical conductor, wherein the extruding is conducted under ambient atmospheric conditions; cooling the coated electrical conductor; heat-treating the cooled, coated electrical conductor; and cooling the heat-treated coated electrical conductor to provide the insulated electrical conductor.

Embodiment 17

The method of the preceding embodiment, wherein the extruding employs pressure coating tooling.

Embodiment 18

The method of any preceding embodiment, wherein the extruding employs jacket coating tooling.

Embodiment 19

The method of any preceding embodiment, wherein the heat-treating comprises subjecting the cooled, coated electrical conductor to a temperature at or above the glass transition temperature of the polymeric insulating coating.

Embodiment 20

The method of any preceding embodiment, wherein the heat-treating further comprises holding the heated coated electrical conductor at the temperature for a specified period of time.

Embodiment 21

The method of any preceding embodiment, wherein the extruding and heat-treating are conducted under ambient atmosphere.

Embodiment 22

The method of any preceding embodiment, wherein the electrical conductor is a wire.

Embodiment 23

The method of any preceding embodiment, wherein the electrical conductor has a cross-sectional shape that is round, square, triangular, rectangular, polygonal, or elliptical.

Embodiment 24

The method of any preceding embodiment, wherein the electrical conductor comprises copper, aluminum, or a combination thereof.

Embodiment 25

The method of any preceding embodiment, wherein the electrical conductor comprises a silver, nickel, or gold coating.

Embodiment 26

The method of any preceding embodiment, wherein the insulating coating comprises a polyaryl ether ketone (PAEK).

Embodiment 27

The method of any preceding embodiment, wherein the insulating coating further comprises one or more fibers, fillers, or a combination thereof.

Embodiment 28

The method of any preceding embodiment, wherein the insulating coating consists essentially of a polyaryl ether ketone (PAEK).

Embodiment 29

The method of any preceding embodiment, wherein the insulating coating comprises a polymer selected from the group consisting of polyether ketone (PEK), polyether ether ketone (PEEK), polyetherketoneketone (PEKK), polyether ether ketone ketone (PEEKK), and polyether ketone ether ketone ketone (PEKEKK).

Embodiment 30

The method of any preceding embodiment, wherein the insulating coating comprises a polymeric alloy of a PAEK with one or more fluororesins.

Embodiment 31

An insulated electrical conductor, prepared according to the method of any preceding embodiment.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise. Other aspects and advantages of the present invention will become apparent from the following.

BRIEF DESCRIPTION OF THE DRAWINGS

In order to provide an understanding of embodiments of the invention, reference is made to the appended drawings, which are not necessarily drawn to scale, and in which reference numerals refer to components of exemplary embodiments of the invention. The drawings are exemplary only, and should not be construed as limiting the invention.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise.

The present disclosure provides a coated electrical conductor and to a method for producing such a coated electrical conductor. The coating is typically an insulating material, as will be described more thoroughly herein below, such that the coated electrical conductor is an insulated electrical conductor. Surprisingly, the coated electrical conductor provided herein can be produced under an ambient atmosphere (e.g., without rigorous exclusion of oxygen), such that the coated electrical conductor comprises at least a partial oxide layer between the insulating coating and the electrical conductor. Nonetheless, as will be demonstrated herein, the insulating coating and the electrical conductor exhibit sufficient adhesion and, in some embodiments, excellent adhesion, contrary to conventional understanding regarding the importance of eliminating such an oxide layer.

Figure 1:
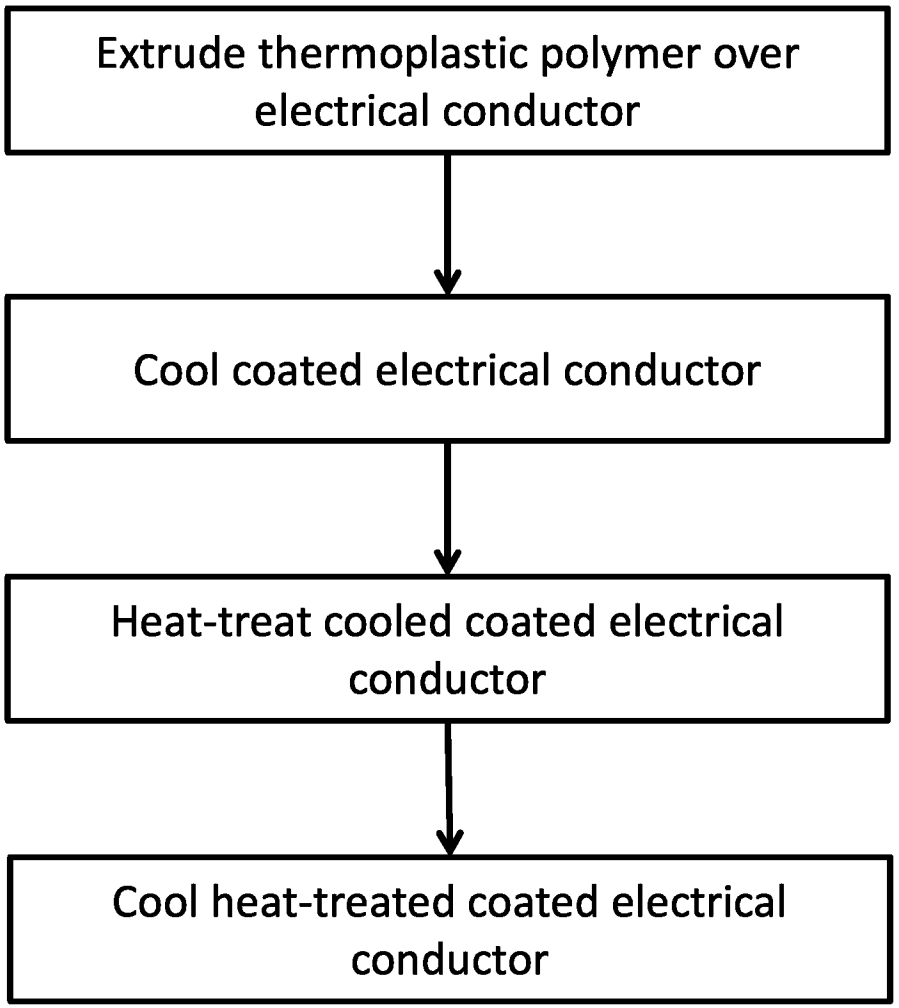
FIG. 1 is a general schematic of a method of the present disclosure.

In a first aspect, the disclosure provides a method for producing a coated electrical conductor, as generally outlined in FIG. 1. As shown, the method comprises four steps, namely, an extrusion step to provide a coated electrical conductor, cooling the resulting coated electrical conductor, a heat treatment step, and a second cooling step to provide the desired product. The extrusion step generally comprises melting a thermoplastic polymer and applying it onto the surface of the electrical conductor. Either a pressure or jacket coating technique can be employed in the extrusion step of the disclosed method. Extrusion is commonly done using instrumentation specific for this purpose, which comprises a means for directing the electrical conductor into a die orifice and drawing the electrical conductor therethrough and contacting it with melted polymer such that the wire is drawn away under conditions that produce a pre-determined insulating coating thickness. Methods for extrusion of a thermoplastic polymer over an electrical conductor are known. Exemplary methods are disclosed, for example, in https://www.victrex.com/~/media/literature/en/victrex_extrusion-brochure.pdf, which is incorporated herein by reference in its entirety. One of skill in the art is aware of modifying processing conditions, e.g., to achieve consistent insulating coatings and to obtain varying coating thicknesses and the like.

Advantageously, extrusion according to the present disclosure need not be conducted in the absence of oxygen. In fact, in certain embodiments, the extrusion step is conducted under an ambient atmosphere (such as in (untreated) air, wherein oxygen is not intentionally removed from the atmosphere. The extrusion can thus, in some embodiments, be described as being conducted in the presence of oxygen. No pre-treatment steps are required to ensure that the electrical conductor is substantially oxide free prior to the extrusion of the insulating coating thereon (e.g., plasma treatments under an oxygen-free protective gas atmosphere, as outlined in EP3441986, which is incorporated herein by reference in its entirety).

The materials employed in the extrusion can vary. The electrical conductor generally comprises any material suitable for electrical conductivity. In particular embodiments, the electrical conductor comprises a metal that is capable of oxidizing, and in certain such embodiments, the electrical conductor comprises such a metal on at least a portion of the surface thereof. Typically, the electrical conductor comprises a metal, such as a material comprising copper, aluminum, or a combination or alloy thereof. In some embodiments, the electrical conductor can comprise a coating thereon, such as a metal coating. The metal coating can comprise, for example, silver, nickel, or gold (providing a metal-coated/metal-plated conductor). Although the disclosure references application of thermoplastic polymers over electrical conductors, it is noted that the principles and methods outlined herein may be employed for the application of thermoplastic polymers over other materials (e.g., over materials comprising metals that are not electrical conductors).

The size and shape of the electrical conductor can vary. In certain embodiments, the electrical conductor is a wire. For example, the electrical conductor may be a copper-containing wire (e.g., a copper wire), an aluminum-containing wire (e.g., an aluminum wire), or a plated copper-containing or aluminum-containing wire. The electrical conductor can have any cross-sectional shape, such as round, square, triangular, rectangular, polygonal, or elliptical, so long as the size and shape is compatible with the extrusion equipment employed in the method.

The polymeric material applied to the electrical conductor comprises a thermoplastic polymer, as known in the art, e.g., which can be softened and melted by the application of heat and can be processed in liquid state (e.g., by extrusion). In certain embodiments, the polymeric material comprises a polyaryl ether ketone (PAEK). PAEKs are a family of semi-crystalline thermoplastic polyketones. The polymeric material typically comprises a majority of PAEK, i.e., at least about 70% by weight of the PAEK (with the remainder being, for example, fillers, fibers, or other polymers as described in further detail below). In further embodiments, the polymeric material comprises at least about 80%, at least about 90%, at least about 95%, at least about 98%, or at least about 99% by weight of the PAEK. The polymeric material can, in some embodiments, consist essentially of the PAEK. Exemplary PAEK polymers include, but are not limited to, those selected from the group consisting of polyether ketone (PEK), polyether ether ketone (PEEK), polyetherketoneketone (PEKK), polyether ether ketone ketone (PEEKK), and polyether ketone ether ketone ketone (PEKEKK).

As referenced above, in some embodiments, the polymeric material comprises, in addition to the PAEK, one or more additional components. Generally, the polymeric material can include, in addition to the PAEK, any additive suitable for property enhancement, where the PAEK serves as the primary insulation. In some embodiments, the polymeric material comprises a PAEK and one or more fibers, fillers, or a combination thereof. The fibers and/or fillers that are optionally included within the thermoplastic polymers disclosed herein can be, for example, any materials known to be useful for enhancement of one or more of the polymer properties. Various relevant fillers are known and can be employed within the resins and/or corresponding insulating coatings disclosed herein. Certain exemplary fillers and other additives include, but are not limited to, glass spheres, glass fibers, carbon in all forms (e.g., color, nanotubes, powder, fiber), radio opacifiers such as barium sulfate ($BASO_4$), bismuth subcarbonate, bismuth oxychloride, tungsten, cooling fillers such as a Boron Nitride (BN) matrix, colorants/pigments, processing aids, and combinations thereof.

In other embodiments, the polymeric material can comprise one or more additional polymers (e.g., such that a polymeric alloy with a PAEK is provided). For example, the polymeric material can, in some embodiments, comprise one or more fluoropolymers. Various fluoropolymers are known to be readily miscible into PAEKs up to rather high percentages (e.g., up to 30%), and such combinations/alloys can be employed in the methods provided herein. In some embodiments, the inclusion of one or more fluoropolymers with the PAEK provides physical benefits, as fluoropolymers generally have exceptional electrical properties regarding permittivity and dielectric (but are often poor in abrasion resistance and unbondable), and can lend certain characteristics to the material, such as reducing friction (which may make it easier for the resulting product to install more easily, e.g., in tightly filled motor slots). In some embodiments, the content of the additional polymer(s) is maintained at a somewhat low level, e.g., such that about 70% or more of the polymeric material comprises the PAEK or about 80% or more, about 85% or more, about 90% or more, about 95% or more, about 98% or more, or about 99% or more of the polymeric material comprises the PAEK.

After the extrusion step, the resulting coated electrical conductor is cooled at least slightly, e.g., below the glass transition temperature (Tg) of the material. Following this cooling, the coated electrical conductor is subjected to heat treatment. This heat treatment step generally comprises treating the coated electrical conductor at an elevated temperature, e.g., at or above the Tg of the insulating coating on the coated electrical conductor. In some embodiments, this temperature may be at or above the melting point (Tm) of the polymeric resin. In various embodiments, any temperature sufficient to remelt the resin, at least in part, is sufficient for this heat treatment step. The parameters of the heat treatment are not particularly limited and the heat treatment can advantageously be conducted in an atmosphere comprising oxygen, e.g., in ambient atmospheric conditions such as in (untreated) air. Suitable methods for heating are widely known and can be employed in the process disclosed herein. For example, in various embodiments, the heat treatment step is conducted by subjecting the coated electrical conductor to heat produced within an oven. In various embodiments, the heat treatment step can employ one or more of radiant heating, infrared heating, induction heating, microwave heating, heating via conduction with fluids, convection heating, and any combinations thereof. In some embodiments, the heat treatment comprises a single heating; however, it is not limited thereto. In some embodiments, the coated electrical conductor is heated two or more times (with cooling in between). Such multiple heatings may be desirable in certain embodiments to ensure that the coating is molten and can flow to obtain sufficient adhesion.

In the heat treatment step, the coated electrical conductor is heated (once, or more than once, as referenced above) and then held at the referenced elevated temperature for a given period of time. This period of time can vary, and may be, for example, anywhere from a few seconds or a few minutes to a few hours. As an example, the heating may be, in some embodiments, conducted by placing the coated electrical conductor in an oven and holding it there for a period of time of about 1 minute or more, e.g., about 1 minute to about 2 hours or about 5 minutes to about 30 minutes.

The heat-treated coated electrical conductor is cooled after heat treatment, e.g., to ambient temperature. The resulting coated electrical conductor surprisingly exhibits sufficient, and even excellent, adhesion between the conductor and the insulating coating thereon. In particular, such coated electrical conductors have been found to be highly resistant to delamination of the insulating coating layer from the underlying electrical conductor. It was thus surprisingly found that the method outlined herein leads to unique properties associated with the resulting coated electrical conductor. Although not intending to be limited by theory, it is believed that the multi-step method outlined herein (including extrusion, cooling, and re-heating the coated conductor) provides a coated product with good bonding between a metal oxide layer at the surface of the conductor and the PAEK present in the adjacent polymeric insulating material. Test data referenced in the Examples herein below in the form of plaque testing indicates that, in fact, the bond created between the metal oxide and the PAEK is unexpectedly greater in strength than the bond between the metal oxide and the metal of the conductor. It is noted that, in some embodiments, it may be beneficial to measure changes in the dynamic mechanical response of the coated electrical conductor (described in further detail herein below) to identify conditions for use in the disclosed method which provide for sufficient adhesion between the conductor and the insulating layer.

The coated electrical conductor provided herein comprises the electrical conductor and insulating coating thereon, with metal oxides between the conductor and the insulating coating, which distinguishes it from certain known coated electrical conductors. It is understood that the specific metal oxide(s) present will be dependent upon the makeup of the electrical conductor (e.g., a copper electrical conductor will comprise copper oxides). The extent of oxides present between the conductor and insulating coating can vary based on processing conditions, for example, the specific environment in which the steps of the method are conducted, the time for which the material is held at elevated temperature in the heat treating step, and the temperature of extrusion and/or heat treatment. As referenced above, although not quantified, it is believed that the disclosed coated conductors comprise strong bonds between metal oxides present at the surface of the conductor and the PAEK of the insulating polymer. Again, not intending to be limited by theory, it is believed that the presence of these bonds between the PAEK of the insulating polymer and the metal oxide lead to the referenced strength/integrity of the coated products (rendering them largely not susceptible to the types of stripping/peelability referenced herein below with respect to conventional products).

The coated electrical conductor of the present disclosure is typically distinguished from certain known coated electrical conductors not only by means of the oxides and the types of bonds formed thereby, but also by means of its physical properties, namely, the bond strength between the electrical conductor and the insulating coating. Bond strength can be evaluated in various manners.

In some embodiments, the disclosed coated electrical conductor is described in terms of the manual peelability (also referred to herein as "strippability") of the insulating coating from the underlying electrical conductor. A strippable insulating coating can be pulled off the conductor in tube form with ease. As the peelability is reduced, this becomes impossible to do and the insulating coating is, instead, pulled off in pieces. For example, a manual peel test can be conducted wherein a nick/tear is initiated in the insulating coating, and the insulating coating is pulled/peeled along the length of the coated electrical conductor to attempt to peel the insulating coating off the conductor. Products exhibiting insufficient adhesion readily peel along the length of the coated electrical conductor, e.g., in one long full piece of insulating coating. Products within the scope of the present disclosure do not exhibit such strippability. Rather, the disclosed coated electrical conductors have sufficient adhesion to not peel to any significant extent (e.g., such that the insulating layer may not be peeled from the underlying electrical conductor in full or partial tubular form). See the examples for a non-limiting demonstration of manual peelability.

In certain embodiments, the present coated electrical conductor exhibits only chipping of small sections of the insulating coating when nicking/tearing and/or peeling is attempted. Various products described herein exhibit the latter property, i.e., the insulating coating is not readily peelable from the underlying electrical conductor. In some embodiments, the disclosed coated electrical conductor is described as exhibiting no significant delamination (including no delamination), particularly between the insulating coating and the electrical conductor) following aggressive forming. Aggressive forming is generally understood in the art as, for a round wire, wrapping it around its own diameter and examining the inner diameter (ID) of the forming for the creating of wrinkles or delaminination. In the case of aggressive forming of rectangular sections, the wrapping can be replaced with a part bent on the long axis, short axis, cork screw bending of any inside radius, or all contortions can be handled without delamination, cracking, or adverse damage being evident. Delamination is a mode of failure where the material separates into layers (here, the insulating coating separates from the electrical conductor). Delamination can be readily observed visually, i.e., by viewing the interface between the conductor and the insulating coating. Advantageously, in various embodiments, no visual delamination will be observed to the naked eye (i.e., without magnification) both before and after subjecting the disclosed coated conductors to the referenced aggressive forming methods. Various test methods are known and may be employed to evaluate the lack of delamination as well.

In some embodiments, the disclosed coated electrical conductor is described in terms of its bond strength as demonstrated by its damped dynamic mechanical response. It has been found that treatment extent dampens the dynamic mechanical response of the polymer-coated wire, and that this damping is indicative of the adhesion of the polymer to the wire. Damping can be determined, e.g., from a dynamic temperature scan of tan δ on a Dynamic Mechanical Analyzer (DMA). See, e.g., K. P. Menard, *Dynamic Mechanical Analysis: A Practical Introduction*, CRC Press, 1999, which is incorporated herein by reference. Tan δ is defined as the ratio of the loss modulus (E") to the storage modulus (E'), and is thus indicative of damping due to viscous dissipation of energy. This analysis is very similar to the heat treatment step of the disclosed method (taking a coated wire and examining the dynamic response in a first versus second heat, where the second heat is indicative of a post-heat treated product).

Figure 2:
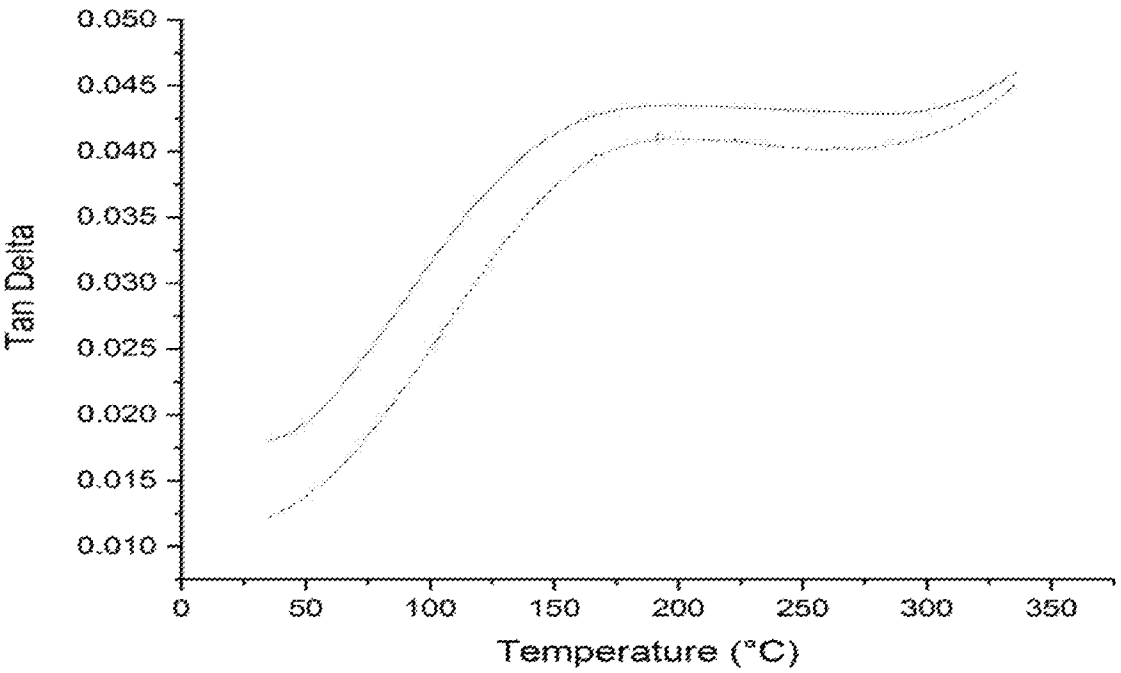
FIG. 2 is a graph of tan δ dynamic temperature scan for bare copper wire.
Figure 3:
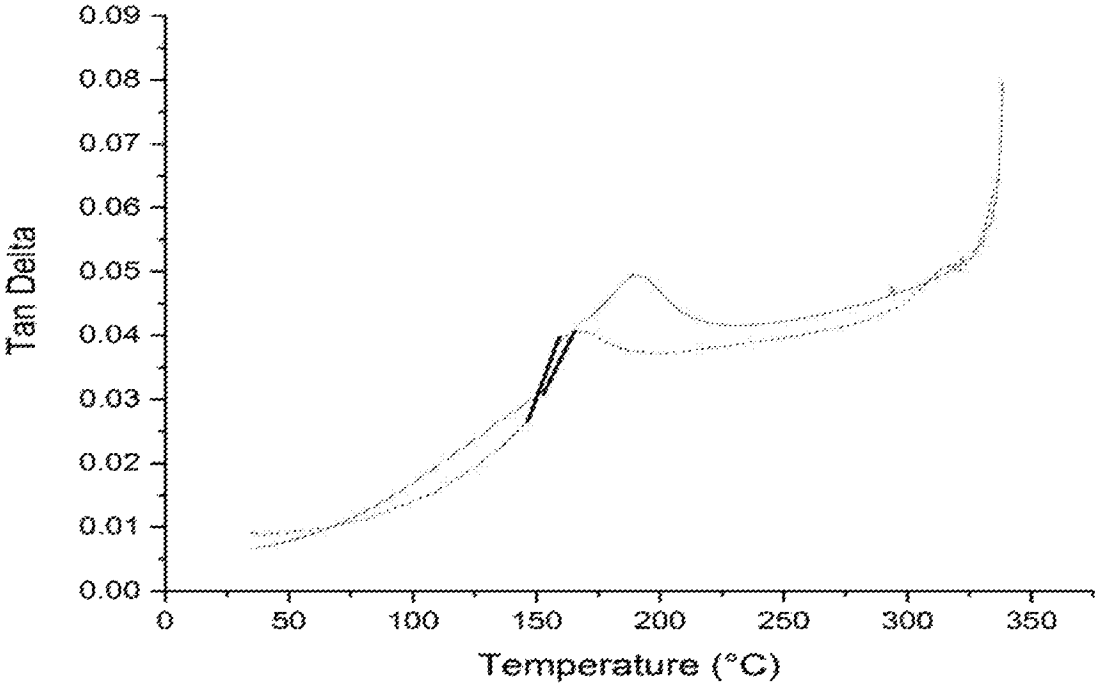
FIG. 3 is a graph of tan δ scans for the heat-treated sample of Example 1 showing calculation of the slopes in the first scan (solid line) and second scan (dotted line)
Figure 4:
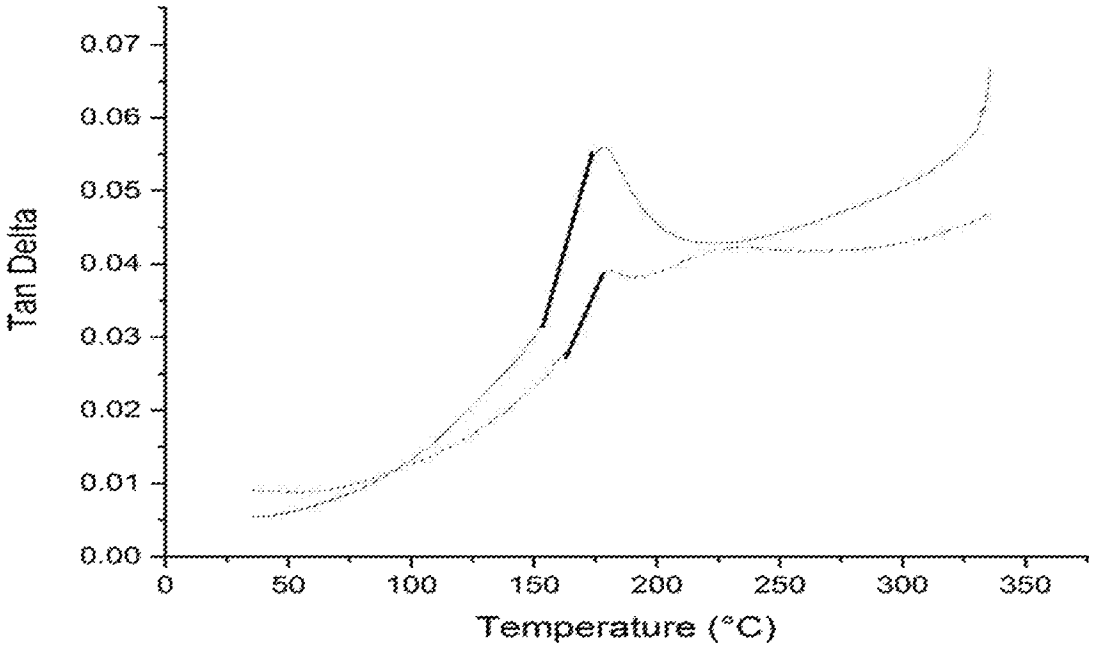
FIG. 4 is a graph of tan δ scans for the untreated sample of Example 1 showing calculation of the slopes in the first scan (solid line) and second scan (dotted line).

For example, if a bare copper wire is subjected to a dynamic temperature scan, the plot of tan δ versus temperature is unremarkable, with no clear transition peaks present. See FIG. 2. If an insulated copper wire is subjected to the same DMA method, the plot of tan δ versus temperature will show a distinct transition in a range typical for the polymer of the insulating layer as seen in FIGS. 3 and 4. As an example, for PEEK, the transition begins above 150° C.

It has now been recognized that a strongly adhering insulating coating layer will have a dampened response in the tan δ transition region compared to a weakly adhering polymer layer. The effect can be quantified by calculating the slope of the curve at the start of the thermal transition during a first dynamic temperature scan. The insulated wire is then maintained at its peak melting temperature (as determined by differential scanning calorimetry, DSC) for one minute and then cooled to room temperature. A second slope is then calculated during a subsequent dynamic temperature scan. By dividing the slope obtained during a first scan with the slope obtained during a second scan, the extent of the damping can be quantified.

The inventors have found that the extent of tan δ damping is indicative of the adhesion between the polymer and the conductor. For certain embodiments, in the case of insufficient adhesion, the damping ratio is greater than 1.10, e.g., for wires having a circular cross-section. In other words, the heating of the insulator and wire during the dynamic temperature scan results in a significant change in the slope of tan δ between heating cycles when adhesion is poor. One such exemplary embodiment is illustrated in FIG. 3. In such embodiments, in the case of good adhesion, however, the effect of the heating cycle on tan δ is more subdued and the ratio is 1.10 or less. One such exemplary embodiment is illustrated in FIG. 4.

This DMA slope is indicative of the intimacy of contact between the conductor and the insulating coating. A non-adhered wire will have micro-slip at the conductor/insulation interface. When running the first DMA cycle on an untreated wire, this is in effect reproducing the heat treatment step of the disclosed method (described in detail above). If the bond had improved the wire will exhibit a different response on the second DMA cycle because of the attachment to the underlying copper oxide layers. On a bonded sample (as provided according to the disclosed method), the difference in slope will be much less because initial micro-slip has already been eliminated through the bonding to the underlying copper oxide layer.

In one specific embodiment, a coated electrical conductor in the form of a wire is provided with a circular cross-section that has a tan δ damping ratio of 1.10 or less when measured according to the following procedure: a) heating a coated wire held by a cantilever grip in a DMA instrument a first time from room temperature up to a temperature, T1, corresponding to a peak of a melting endotherm (determined by DSC); b) cooling the coated wire back to room temperature after one minute at T1; c) heating the coated wire a second time up to T1; d) determining the slope, m1, of the tan δ curve at the start of a thermal transition region of the polymer during the first heating cycle; e) determining the slope, m2, of the tan δ curve at the start of a thermal transition region of the polymer during the second heating cycle; and f) calculating the tan δ damping ratio by dividing m1 by m2.

In another specific embodiment, a coated electrical conductor in the form of a wire is provided with a rectangular cross-section that has a tan δ damping ratio of less than 1.60 when measured according to the following procedure: a) heating a coated wire held by a cantilever grip in a DMA instrument a first time from room temperature up to a temperature, T1, corresponding to a peak of a melting endotherm (determined by DSC); b) Cooling the coated wire back to room temperature after one minute at T1; b) heating the coated wire a second time up to T1; c) determining the slope, m1, of the tan δ curve at the start of a thermal transition region of the polymer during the first heating cycle; d) determining the slope, m2, of the tan δ curve at the start of a thermal transition region of the polymer during the second heating cycle; e) calculating the tan δ damping ratio by dividing m1 by m2.

In a further embodiment is provided a method for obtaining a coated electrical conductor with sufficient level of adhesion between the electrical conductor and the insulating coating. The "sufficiency" can vary, and may be defined according to, for example, any of the methods outlined herein. The method generally comprises manipulating the parameters of the method described herein to obtain a particular dampening of the dynamic mechanical response of the product (e.g., to obtain a tan δ damping ratio of 1.10 or less for a wire with round cross-section or a tan δ damping ratio of less than 1.60 for a wire with a rectangular cross-section.

It is noted that DMA testing can be impacted by, e.g., the presence of a significant amount of filler/additive/other polymer present in the polymer insulating coating. As such, in some embodiments, the test method and results provided herein with respect to DMA may, in some embodiments, be particularly relevant in the context of PAEK-based polymer insulating coatings with low levels of other components (e.g., less than about 10% other components, less than about 5% other components, or less than about 2% other components). As a general consideration, where the DSC trace of the insulating coating is considered to be complex, the DMA method is not as suitable for evaluation.

The properties of certain coated electrical conductors provided herein can be further described on the basis of the partial discharge exhibited in response to longitudinal stretching, as follows. A given strain (e.g., a 20% strain) is applied to the heat-treated and a comparative (non heat-treated) coated wire. Such testing is advantageously designed to isolate Corona discharges on the wire surface and only show defects at the conductor or within the insulating layer itself. The wire is wrapped in 2 loops around a mandrel 5 times the wire diameter, simulating forming in a motor winding application or bend radius installing wire into a system. The testing is designed to determine whether the product exhibits significant air gaps between the conductor and insulating layer once stressed and formed (which would indicate lack of sufficient bonding between the conductor and the layer). Significant air gaps would be evidenced by reaching high partial discharge (e.g., greater than 20 pC PD) at low voltage values (e.g., below 6000 VAC), as described more thoroughly herein below.

In order to isolate Corona (surface discharges) that would be typical in a twisted pair PDIV test where discharge can occur at exterior air gaps, the wire loop wrapped on the mandrel is submerged into a saturated salt water bath. The salt water bath has the ground electrode for the test submerged under the water surface. This salt water bath effectively carries away all charge from the surface of the wire directly to the submerged ground so no Corona effects can be seen on the PD measuring circuit. A dielectric oil or insulating fluid (e.g., silicone oil) can be put on the water surface to prevent discharges at the entry of the wire into the water bath. Corona discharges at the wire surface are easily identifiable by anyone skilled in the art of this electrical testing, can be seen and heard as a characteristic buzzing sound, and results from this surface Corona should be negated. The particular insulating fluid in the embodiments shown was a silicone oil. Such treatment/testing (including the referenced strain and mandrel forming) simulates aggressive handling and motor winding, which are typical conditions to which coated electrical conductors are subjected. Accordingly, such results may, in some embodiments, be particularly relevant to evaluate the ability of a given product to exhibit good bonding under the conditions in which it will be used. In certain embodiments, a value of 6000 VAC or greater is exhibited by the disclosed coated conductors in this testing without a sustained 20 pC discharge. It is noted that this testing is not always conclusive for every embodiment; for example, a very thin coated conductor may fail before 6000 VAC; however, for certain coated conductors, evaluation of the bond strength in this way is a useful method to confirm that a product exhibits sufficient properties to render it useful without significant delamination in relevant contexts.

The 20% strain and then aggressive forming in this testing method is designed to create air voids. A product that has been subjected to the method provided in the present disclosure will not exhibit partial discharge similar to the values previous disclosed (up to 6000 VAC) or dielectric failure occurs in the bath (for a very thin coating). Sustained discharge in excess of 20 Pc or less will not occur in a properly adhered wire (provided according to the disclosed method) after 20% strain and aggressive forming. There are occasions where a non-bonded wire can be strained 20% and aggressively formed without an air gap presenting; this would not show a 20 pC sustained discharge either but would be evident on the DMA test response on slope analysis upon heat treatment. As such, a combination of the partial discharge analysis and DMA analysis disclosed herein above may, in some embodiments, may be particularly suitable for analyzing coated wires.

It is to be understood that the disclosed coated electrical conductors and associated methods are not limited to electrical conductors with a single insulating (e.g., PAEK) coating thereon. Rather, the disclosure is intended to further encompass products with one or more additional layers coated thereon. As described and exemplified herein, the inventors have uniquely developed the capability of forming a strong bond between an electrical conductor and a thermoplastic polymer coating; further layers are not particularly limited once this first coating is obtained (as provided herein). As such, coated electrical conductors with one, two, three, four, five, or even more additional layers are also within the scope of this disclosure, wherein these additional layers can be the same or different from one another and can comprise, for example, any polymers that would bond either through co-extrusion or subsequently layering, to the insulating coating polymer. Such optional additional layers can be completely polymeric or which can contain any of the types of fillers and/or additives referenced herein above. The insulated conductors disclosed herein can be used in varying applications. For example, in some embodiments, the disclosure provides an electric motor comprising one or more insulated electrical conductors as disclosed herein.

Example 1: PEEK (Vestakeep 5000G) Over AWG 15 Cu Wire

Two samples were manufactured, one with the heat treatment step and one without. The wire was an AWG 15 Cu wire, and a 0.006" nominal insulation layer of PEEK was applied using a ¾" 24:1 thermoplastic extruder utilizing a tube coating crosshead at a rate of 9 FPM. The wires were preheated prior to coating with an external heat source to approximately 400° F. in an oxygen-containing environment (ambient air). A 0.285" die and a 0.210 mandrel (designed for a sleeve-coating technique, which is generally considered to be disadvantageous for bond formation) were used to set the drawdown of the PEEK thermoplastic on the AWG 15 wires. After extrusion, each coated product was fully cooled; one product was not further processed, and the other was subsequently heated above the PEEK glass transition temperature (to melt) and allowed to cool in ambient air. Methods of characterizing these samples are provided below, with all characterization data presented in Table 1, below Example 5.

Manual Peelability

A method relying on the manual propagation of peeling was used to evaluate the adhesion strength between the insulating coating and the conductor. A 1.5" length is removed from around the circumference of the insulated wire near one end. A razorblade is then used to slice through the insulating coating for a length of 0.5" starting at this end. The effort required to separate the insulating coating from the wire is then evaluated on a scale of 1 to 3. A value of 1 is assigned if the insulation peels away with little to no effort after making the incision. A value of 2 is assigned if effort is required to begin peeling the insulation layer, but once initiated it readily peels away. A value of 3 is assigned if the insulation does not peel off, or if it peels off in sections less than 0.125". The manual propagation of peeling test resulted in a value of "1" for the sample that was not heat-treated and in a value of "3" for the sample that was heat-treated.

Damping Ratios

A TA Instruments DSC Q2000 was used to characterize the thermal behavior of the sample using ASTM D3418-15: *Standard Test Method for Transition Temperatures and Enthalpies of Fusion and Crystallization of Polymers by Differential Scanning calorimetry,* 2015. Insulation was removed from the conductor and equilibrated at 30° C. in an aluminum pan and then heated at a constant rate of 10° C./min to 400° C. A constant rate of 10° C./min was then used to cool the sample back to 30° C. The sample was once again heated to 400° C. at a rate of 10° C./min. DSC data were analyzed using TA Instruments Universal Analysis 2000 v4.5A software. The peak of the melting endotherm was determined to be 339° C.

DMA testing was performed to determine the tan δ curves in dynamic temperature scans, based on ASTM D4065-12: *Standard Practice for Plastics: Dynamic Mechanical Properties: Determination and Report of Procedures,* 2012, which is incorporated herein by reference. A TA instruments Q800 DMA with a cantilever fixture was used to determine tan δ by dynamic temperature scan from room temperature to 339° C. with an isothermal hold for one minute at 339° C. The sample was heated at a constant rate of 3° C./min while being displaced at a constant amplitude of 30 μm with a fixed frequency flexural oscillation of 1 Hz. When the initial temperature scan was complete, the sample was allowed to cool to room temperature. A second dynamic temperature scan was then performed using the same parameters as the initial heating ramp. After both heating cycles were completed the DMA data were imported into OriginLab's OriginPro 2019b v.9.65 data analysis and graphing software. A slope was calculated after the inflection point corresponding to the thermal transition of the insulation layer. The ratio of the slopes obtained for each dynamic temperature scan was then taken by dividing the first slope by the second slope. For the case where the sample was not heat-treated, this ratio is 1.65. For the case where the sample was heat-treated, the ratio is 0.76.

Example 2: PEEK (Solvay KT-820NT) Over AWG 15 Cu Wire

Two samples were manufactured, one with the heat treatment step and one without. These samples were prepared analogously to the samples of Example 1, with the exception that a different PEEK resin was used, and the rate of extrusion was 8 feet per minute. Characterization data is presented in Table 1, below Example 5.

Example 3: PEEK (Victrex 381G) Over AWG 18 Cu Wire

Two samples were manufactured, one with the heat treatment step and one without (prepared similarly to the method of Example 1, above). The wire was an AWG 18 Cu wire, and a 0.00145" nominal insulation layer of PEEK was applied using a ¾" 24:1 thermoplastic extruder utilizing a tube coating crosshead at a rate of 15.5 FPM. The wires were preheated prior to coating with an external heat source to approximately 400° F. A 0.253" die and a 0.200 mandrel were used to set the drawdown of the PEEK thermoplastic on the AWG 18 wires. After extrusion, each coated product was fully cooled; one product was not further processed, and the other was subsequently heated above the PEEK glass transition temperature (to melt) for one hour and allowed to cool in ambient air. Characterization data is presented in Table 1, below Example 5.

Comparative Example 1: Dacon D-20APK2 AWG 20 Cu Wire

This is a comparative commercial product (PEEK over Cu wire) with a nominal wall thickness of 0.003. The PEEK coating slid easily off the coated product with wire strippers, and would not hold up to formability.

Example 4: PEEK (Victrex 150G) Over AWG 20.5 Cu Wire

A sample was manufactured with the heat treatment step (prepared similarly to the corresponding method of Example 1, above). The wire was an AWG 20.5 Cu wire, and a 0.0039" nominal insulation layer of PEEK was applied. The wire was preheated prior to coating with an external heat source to approximately 400° F. After extrusion, the coated product was fully cooled. It was subsequently heated above the PEEK glass transition temperature (to melt) for one hour and allowed to cool in ambient air. Characterization data is presented in Table 1, below Example 5.

Example 5: PEEK (Solvay KT-820NT) Over Cu Rectangular Wire

Two samples were manufactured, one with the heat treatment step and one without (prepared similarly to the method of Example 1, above). The wire was a Cu rectangular wire, and a 0.0075" nominal insulation layer of PEEK was applied using a 1" 24:1 thermoplastic extruder utilizing a tube coating crosshead at a rate of 3.6 FPM. The wires were preheated prior to coating with an external heat source to approximately 400° F. A 0.400" die and a 0.361 mandrel were used to set the drawdown of the PEEK thermoplastic on the rectangular wires. After extrusion, each coated product was fully cooled; one product was not further processed, and the other was subsequently heated above the PEEK glass transition temperature (to melt) for one hour and allowed to cool in ambient air. Characterization data is presented in Table 1, below this example.

The different resins and wires tested in various examples demonstrated little to no variability associated with the particular resin selected or the particular wire selected (size and/or shape). As a result, it is understood that the disclosed method is not resin grade-specific, and PAEK resins, as well as filled resins and alloyed resins were also found to perform suitably using the disclosed method (based, e.g., on tan delta lowering for the heat-treated value, bond improving and formability possible without evidence of significant delamination).

TABLE 1

| Example | Heat-Treatment | Tan δ slope ratio | Peelability Value |
|---|---|---|---|
| 1 | No | 1.65 | 1 |
| | Yes | 0.76 | 3 |
| 2 | No | 1.53 | 1 |
| | Yes | 0.98 | 3 |
| 3 | No | 1.18 | 1 |
| | Yes | 1.07 | 2 |
| Comparative 1 | N/A | 2.75 | 1 |
| 4 | Yes | 1.10 | 3 |
| 5 | No | 2.59 | 1 |
| | Yes | 1.56 | 2 |

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An insulated electrical conductor, comprising:

an electrical conductor comprising an oxide layer on at least part of a surface of the electrical conductor; and an insulating coating on at least a portion of the oxide layer, wherein:

a combination of the electrical conductor and the insulating coating has been subjected to heat treatment after the insulating coating is applied to at least the portion of the oxide layer, the heat treatment comprising heating to a temperature at or greater than the melting temperature of the insulating coating; and the insulated electrical conductor exhibits adhesion between the insulating coating and one or more of the electrical conductor and the oxide layer such that the insulating coating is not strippable from the electrical conductor after the heat treatment.

2. The insulated electrical conductor of claim 1, wherein the electrical conductor is a wire.

3. The insulated electrical conductor of claim 1, wherein the electrical conductor has a cross-sectional shape that is round, square, triangular, rectangular, polygonal, or elliptical.

4. The insulated electrical conductor of claim 1, wherein the electrical conductor comprises copper, aluminum, or a combination or alloy thereof.

5. The insulated electrical conductor of claim 4, wherein the electrical conductor comprises copper or a copper alloy.

6. The insulated electrical conductor of claim 1, wherein the electrical conductor comprises a silver, nickel, or gold coating.

7. The insulated electrical conductor of claim 1, wherein the insulating coating comprises a polyaryl ether ketone (PAEK).

8. The insulated electrical conductor of claim 2, wherein the insulating coating comprises a polyaryl ether ketone (PAEK).

9. The insulated electrical conductor of claim 1, wherein the insulating coating further comprises one or more fibers, fillers, or a combination thereof.

10. The insulated electrical conductor of claim 2, wherein the insulating coating further comprises one or more fibers, fillers, or a combination thereof.

11. The insulated electrical conductor of claim 1, wherein the insulating coating consists essentially of a polyaryl ether ketone (PAEK).

12. The insulated electrical conductor of claim 2, wherein the insulating coating consists essentially of a polyaryl ether ketone (PAEK).

13. The insulated electrical conductor of claim 1, wherein the insulating coating comprises a polymer selected from the group consisting of polyether ketone (PEK), polyether ether ketone (PEEK), polyetherketoneketone (PEKK), polyether ether ketone ketone (PEEKK), and polyether ketone ether ketone ketone (PEKEKK).

14. The insulated electrical conductor of claim 2, wherein the insulating coating comprises a polymer selected from the group consisting of polyether ketone (PEK), polyether ether ketone (PEEK), polyetherketoneketone (PEKK), polyether ether ketone ketone (PEEKK), and polyether ketone ether ketone ketone (PEKEKK).

15. The insulated electrical conductor of claim 1, wherein the insulating coating comprises a polymeric alloy of a PAEK with one or more fluororesins.

16. The insulated electrical conductor of claim 2, wherein the insulating coating comprises a polymeric alloy of a PAEK with one or more fluororesins.

17. The insulated electrical conductor of claim 1, wherein the electrical conductor is a wire with a circular cross-section that has a tan δ damping ratio of 1.10 or less when measured according to the following procedure:

a) heating a coated wire held by a cantilever grip in a DMA instrument a first time from room temperature up to a temperature, T1, corresponding to a peak of a melting endotherm (determined by DSC);

b) cooling the coated wire back to room temperature after one minute at T1;

c) heating the coated wire a second time up to T1;

d) determining the slope, m1, of the tan δ curve at the start of a thermal transition region of the polymer during the first heating cycle;

e) determining the slope, m2, of the tan δ curve at the start of a thermal transition region of the polymer during the second heating cycle; and f) calculating the tan δ damping ratio by dividing m1 by m2.

18. The insulated electrical conductor of claim 17, wherein the electrical conductor is a wire.

19. The insulated electrical conductor of claim 17, wherein the electrical conductor is a wire comprising copper or a copper alloy.

20. The insulated electrical conductor of claim 1, wherein the electrical conductor is a wire with a rectangular cross-section that has a tan δ damping ratio of less than 1.60 when measured according to the following procedure:

a) heating a coated wire held by a cantilever grip in a DMA instrument a first time from room temperature up to a temperature, T1, corresponding to a peak of a melting endotherm (determined by DSC);

b) cooling the coated wire back to room temperature after one minute at T1; b) heating the coated wire a second time up to T1;

c) determining the slope, m1, of the tan δ curve at the start of a thermal transition region of the polymer during the first heating cycle;

d) determining the slope, m2, of the tan δ curve at the start of a thermal transition region of the polymer during the second heating cycle; and e) calculating the tan δ damping ratio by dividing m1 by m2.

21. The insulated electrical conductor of claim 20, wherein the electrical conductor is a wire.

22. The insulated electrical conductor of claim 20, wherein the electrical conductor is a wire comprising copper or a copper alloy.

23. The insulated electrical conductor of claim 1, wherein the insulating coating being not strippable from the electrical conductor is determined by initiating a nick or tear in the insulating coating; peeling the insulating coating from the nick or tear lengthwise in air under ambient conditions along the coated electrical conductor to attempt to peel the insulating coating off the conductor; and observing that the insulating layer is not peeled from the electrical conductor in full or partial tubular form.

24. An electric motor comprising the insulated electrical conductor of claim 1.

25. A method of preparing the insulated electrical conductor of claim 1, comprising:

providing an electrical conductor comprising an oxide layer on at least part of a surface of the electrical conductor;

extruding a polymeric insulating coating onto one or more of the electrical conductor and the oxide layer such that the insulating coating is not strippable from the electrical conductor, wherein the extruding is conducted under ambient atmospheric conditions;

cooling the coated electrical conductor;

heat-treating the cooled, coated electrical conductor; and cooling the heat-treated coated electrical conductor to provide the insulated electrical conductor.

26. An insulated electrical conductor, prepared according to the method of claim 25.

* * * * *